US012305503B2

(12) United States Patent
Li et al.

(10) Patent No.: US 12,305,503 B2
(45) Date of Patent: May 20, 2025

(54) FLUID SEALING FOR DOWNHOLE ACOUSTIC MEASUREMENT TOOL

(71) Applicant: Schlumberger Technology Corporation, Sugar Land, TX (US)

(72) Inventors: Zheng Li, Clamart (FR); Orland Guedes, Clamart (FR); Stephane Guimont, Clamart (FR); Viet Tung Nguyen, Clamart (FR); Roel Van Os, Clamart (FR); Hiroshi Hori, Clamart (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/460,635

(22) Filed: Sep. 4, 2023

(65) Prior Publication Data

US 2025/0075615 A1 Mar. 6, 2025

(51) Int. Cl.
*E21B 47/107* (2012.01)
*E21B 47/017* (2012.01)
*E21B 47/14* (2006.01)

(52) U.S. Cl.
CPC ..... *E21B 47/107* (2020.05)

(58) Field of Classification Search
CPC ..... E21B 47/107; E21B 47/01; E21B 47/017; E21B 47/14; E21B 47/16; Y10S 367/911; G01V 1/44; G01V 1/52
USPC ..... 181/102
See application file for complete search history.

(56) References Cited

U.S. PATENT DOCUMENTS

| | | | | |
|---|---|---|---|---|
| 2,868,311 | A * | 1/1959 | Tullos | G01V 1/52 181/104 |
| 3,009,131 | A * | 11/1961 | Woodworth | G01V 1/52 367/185 |
| 3,056,463 | A * | 10/1962 | Summers | G01V 1/52 367/25 |
| 3,378,097 | A | 4/1968 | Straus | |
| 3,390,737 | A * | 7/1968 | Johnson | G01V 1/52 340/856.4 |
| 4,382,290 | A | 5/1983 | Havira | |
| 4,899,844 | A * | 2/1990 | Katahara | G01V 1/44 367/25 |
| 5,343,001 | A * | 8/1994 | Cowles | G01V 1/52 181/102 |
| 5,357,481 | A | 10/1994 | Lester | |
| 6,568,501 | B2 * | 5/2003 | Paulsson | G01V 1/52 181/102 |
| 10,473,808 | B2 * | 11/2019 | Chang | E21B 47/107 |
| 12,065,887 | B2 * | 8/2024 | Lehr | E21B 41/00 |
| 12,084,965 | B2 * | 9/2024 | Kirkpatrick | E21B 47/16 |

(Continued)

OTHER PUBLICATIONS

Combined Search and Exam Report issued in the Great Britain Patent Application No. GB2412699.7 dated Feb. 28, 2025, 6 pages.

*Primary Examiner* — Kenneth L Thompson
(74) *Attorney, Agent, or Firm* — Jeffrey D. Frantz

(57) ABSTRACT

A fluid seal assembly having a sleeve disposed circumferentially around a downhole tool. First and second fasteners extend circumferentially around the sleeve proximate respective first and second ends of the sleeve. The first and second fasteners may comprise a shape-memory alloy that, in response to a temporarily increased temperature, have caused the first and second fasteners to circumferentially compress the sleeve against an outer surface of the downhole tool.

15 Claims, 11 Drawing Sheets

(56) References Cited

U.S. PATENT DOCUMENTS

2016/0290061 A1* 10/2016 Perkins ..... E21B 17/028
2022/0298912 A1* 9/2022 Achalpurkar ..... E21B 17/02

* cited by examiner

FLUID SEALING FOR DOWNHOLE ACOUSTIC MEASUREMENT TOOL

BACKGROUND OF THE DISCLOSURE

Downhole acoustic measurement (or imaging) tools are used in oil and gas exploration and production in both cased and uncased wellbores. For example, when utilized in cased wellbores, such acoustic imaging may be performed to inspect the casing and the cement securing the casing in the wellbore. When utilized in uncased wellbores, acoustic imaging may be performed to obtain an image of the wellbore surface, such as to identify vugs, fractures, texture, and acoustic properties of the subterranean formation penetrated by the wellbore.

The downhole acoustic tools include one or more acoustic sensors disposed near outer boundaries of the tool. A cover in front of the sensor(s) protects the tool interior from wellbore fluid.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

In one or more embodiments, an apparatus can include a downhole tool. The downhole tool can include an acoustic sensor operable for emitting and receiving acoustic signals to perform downhole measurements and a fluid seal assembly. The fluid seal assembly can include a sleeve disposed circumferentially around the downhole tool. The sleeve can be sufficiently acoustically transparent to pass the emitted and received acoustic signals. A first fastener and a second fastener can each extend circumferentially around the sleeve proximate respective first and second ends of the sleeve.

In another embodiment an apparatus can include a downhole tool. The downhole tool can include an acoustic sensor operable for emitting and receiving acoustic signals to perform downhole measurements and a fluid seal assembly. The fluid seal assembly can include a sleeve disposed circumferentially around the downhole tool. The sleeve can be sufficiently acoustically transparent to pass the emitted and received acoustic signals. A first fastener can be disposed circumferentially around the downhole tool. The first fastener can have first internal threads engaged with first external threads of the downhole tool; thereby, compressing a first end of the sleeve against a first surface of the downhole tool. A second fastener can be disposed circumferentially around the downhole tool. The second fastener can have second internal threads engaged with second external threads of the downhole tool; thereby, compressing a second end of the sleeve against a second surface of the downhole tool.

In another embodiment, an apparatus can include a downhole tool. The downhole tool can include an acoustic sensor operable for emitting and receiving acoustic signals to perform downhole measurements when the downhole tool is conveyed within a wellbore. A housing that can include a plurality of interconnected housing portions can collectively define at least a portion of an internal chamber containing the sensor. The adjacent housing portions define gaps that collectively form a fluid pathway between an outer surface of the housing and the internal chamber. At least one of the gaps can terminate at a slot extending along the outer surface. A sleeve can be disposed circumferentially around the housing; thereby, inhibiting wellbore fluid from flowing into the internal chamber via the gaps when the downhole tool is conveyed within the wellbore. A material can be disposed internal to the sleeve and further block entry of the wellbore fluid into the slot.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numbers and/or letters in the various examples. This repetition is for simplicity and clarity and does not in itself dictate a relationship between the various embodiments and/or configurations discussed. Moreover, the description of a first feature in contact with a second feature in the description that follows may include implementations in which the first and second features are in direct contact, and may also include implementations in which additional features may interpose the first and second features, such that the first and second features may not be in direct contact.

Figure 1:
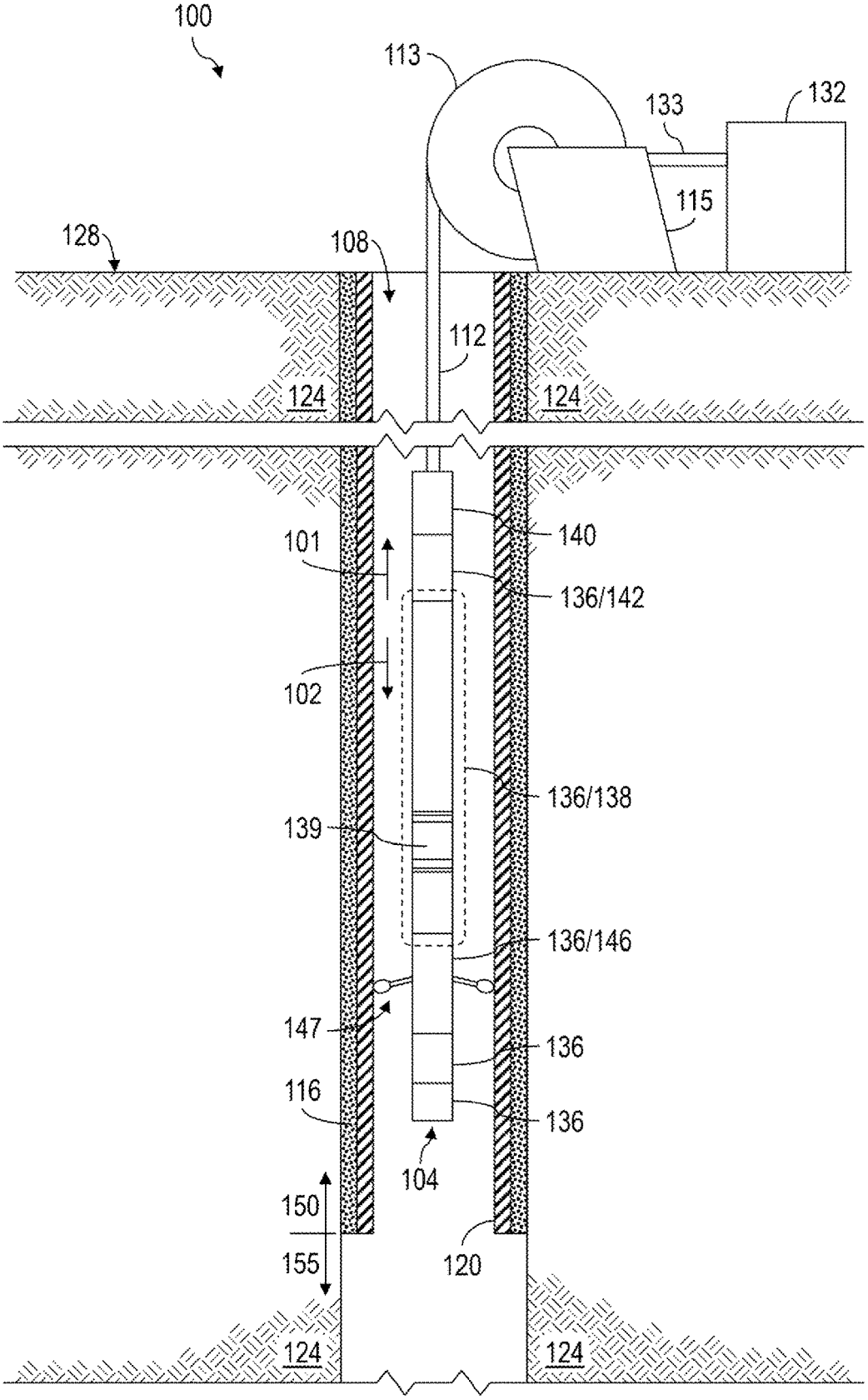
FIG. 1 is a schematic view of at least a portion of an example implementation of apparatus according to one or more aspects of the present disclosure.

FIG. 1 is a schematic view of at least a portion of an example implementation of a wellsite system 100 to which one or more aspects of the present disclosure may be applicable. The wellsite system 100 may be onshore (as depicted) or offshore. In the example wellsite system 100 shown in FIG. 1, a tool string 104 is conveyed in a wellbore (or borehole) 108 via a wireline, slickline, and/or other conveyance means 112. The example wellsite system 100 may be utilized for evaluation of the wellbore 108, cement 116 securing casing 120 within the wellbore 108, a tubular (not shown) secured in the casing 120 (e.g., production services tubing), and/or a subterranean formation 124 penetrated by the wellbore 108 in a cased section 150 and/or an open hole section 155. Although the majority of the wellbore 108 is depicted in FIG. 1 as being cased, a majority of the wellbore may be uncased ("open," without the casing 120 and cement 116).

The tool string 104 is suspended in the wellbore 108 from the lower end of the conveyance means 112. The conveyance means 112 may be a single- or multi-conductor slickline or wireline logging cable spooled on a drum 113 of a winch 115 at the surface 128 of the wellsite from whence the wellbore 108 extends. The wellsite surface 128 is the generally planar surface of the terrain (i.e., Earth's surface), a floor of a rig (not shown) at the wellsite, or other equipment at the wellsite, which is perpendicularly penetrated by the wellbore 108. Operation of the winch 115 rotates the drum 113 to reel in the conveyance means 112 and thereby pull the tool string 104 in an uphole direction 101 in the wellbore 108, as well as to reel out the conveyance means 112 and thereby move the tool string 104 in a downhole direction 102 in the wellbore 108. The conveyance means 112 may include at least one or more conductors (not shown) that facilitate data communication between the tool string 104 and surface equipment 132 disposed at the wellsite surface 128, including through one or more slip rings, cables, and/or other conductors (schematically depicted in FIG. 1 by reference number 133) electrically connecting the one or more conductors of the conveyance means 112 with the surface equipment 132. The conveyance means 112 may alternatively transport the tool string 104 without a conductor inside the cable but with at least one module that can autonomously acquire and/or process and/or store downhole measurements in downhole memory without human intervention or communication with the surface equipment 132.

The tool string 104 comprises a plurality of modules (or "tools") 136, one or more of which may comprise an elongated housing, mandrel, chassis, and/or other structure carrying various electronic and/or mechanical components. For example, at least one of the modules 136 may be or comprise at least a portion of a device for measuring a feature and/or characteristic of the wellbore 108, the casing 120, a tubular installed in the casing 120 (not shown), the cement 116, and/or the formation 124, and/or a device for obtaining sidewall or inline core and/or fluid (liquid and/or gas) samples from the wellbore 108 and/or formation 124. Other implementations of the downhole tool string 104 within the scope of the present disclosure may include additional or fewer components or modules 136 relative to the example implementation depicted in FIG. 1.

The wellsite system 100 also includes a data processing system that may include at least a portion of one or more of the surface equipment 132, control devices and/or other electrical and/or mechanical devices in one or more of the modules 136 of the tool string 104 (such as a downhole controller 140), a remote computer system (not shown), communication equipment, and/or other equipment. The data processing system may include one or more computer systems or devices and/or may be a distributed computer system. For example, collected data or information may be stored, distributed, communicated to a human wellsite operator, and/or processed locally (downhole or at surface) and/or remotely.

The data processing system may, whether individually or in combination with other system components, perform the methods and/or processes described below, or portions thereof. For example, the data processing system may include processor capability for collecting caliper, acoustic (e.g., ultrasonic), and/or other data related to the evaluation of the cement 116, the casing 120, a tubular installed in the casing 120 (not shown), and/or the formation 124, according to one or more aspects of the present disclosure. Methods and/or processes within the scope of the present disclosure may be implemented by one or more computer programs that run in a processor located, for example, in one or more modules 136 of the tool string 104 and/or the surface equipment 132. Such programs may utilize data received from the downhole controller 140 and/or other modules 136 and may transmit control signals to operative elements of the tool string 104, where such communication may be via one or more electrical or optical conductors of the conveyance means 112. The programs may be stored on a tangible, non-transitory, computer-usable storage medium associated with the one or more processors of the downhole controller 140, other modules 136 of the tool string 104, and/or the surface equipment 132, or may be stored on an external, tangible, non-transitory, computer-usable storage medium that is electronically coupled to such processor(s). The storage medium may be one or more known or future-developed storage media, such as a magnetic disk, an optically readable disk, flash memory, or a computer-readable device of another kind, including a remote storage device coupled over one or more wired and/or wireless communication links, among other examples.

As designated in FIG. 1 by reference number 138, at least one of the modules 136 may be or comprise a downhole acoustic (e.g., ultrasonic) measurement tool operable for acquiring acoustic measurements characterizing the wellbore 108, the casing 120, a tubular installed in the casing 120 (not shown), the cement 116, and/or the formation 124. The downhole acoustic measurement tool 138 comprises one or more acoustic transducers 139 (such as a single transducer or a phased array of transducers, among other examples) that may each be operated as an acoustic transmitter and/or receiver. Example implementations of the downhole acoustic measurement tool 138 within the scope of the present disclosure are described below.

As designated in FIG. 1 by reference number 142, another one (or more) of the modules 136 may be or comprise an orientation module permitting measurement of the azimuth of the downhole acoustic measurement tool 138. Such module 142 may include, for example, one or more of a relative bearing (RB) sensor, a gravity/acceleration sensor, a magnetometer, and a gyroscopic sensor.

As designated in FIG. 1 by reference number 146, another one (or more) of the modules 136 may be or comprise a centralizer module. For example, the centralizer module 146 may comprise an electric motor driven by a controller (neither shown) and/or other means for actively extending ("opening") and retracting ("closing") a plurality of centralizing arms 147. Although only two centralizing arms 147 are depicted in the example implementation shown in FIG. 1, other implementations within the scope of the present disclosure may have more than two centralizing arms 147. Extension of the centralizing arms 147 aids in urging the downhole acoustic measurement tool 138 to a central position within the casing 120, another tubular, or the wellbore 108 being investigated by the downhole acoustic measurement tool 138. Implementations of tool strings within the scope of the present disclosure may include more than one instance of the downhole acoustic measurement tool 138 and/or more than one instance of the centralizer module 146. The modules 136 may be conveyed in either or both of open-hole sections 155 and cased-hole sections 150, including implementations in which the centralizer module 146 and the phased array module 138 may be configured or configurable for use in either or both of the two sections. The tool string 104 may also not comprise the centralizer module 146, or may comprise another type of centralizer module, such as a passive centralizer module.

FIGS. 2-30 depict portions of example downhole tools 301, 302, 401-406, 408-422 that each may be an example implementation of and/or comprise one or more features and/or modes of operation of the downhole acoustic measurement tool 138 shown in FIG. 1. Each downhole tool 301, 302, 401-406, 408-422 comprises a sensor section 310 containing an acoustic sensor 311 (e.g., one or more instances of the acoustic sensor 139 in FIG. 1) operable for emitting acoustic excitation signals and/or receiving echo signals to perform downhole measurements. The sensor section 310 may be located between housing portions 312, 314 of each downhole tool 301, 302, 401-406, 408-422. Each downhole tool 301, 302, 401-406, 408-422 also includes an external sleeve 318, 458, 460, 466, 475, 477, 479 surrounding the sensor section 310 and adjacent ends of the housing portions 312, 314 and configured to inhibit wellbore fluid from flowing into the sensor section 310.

Figure 2:
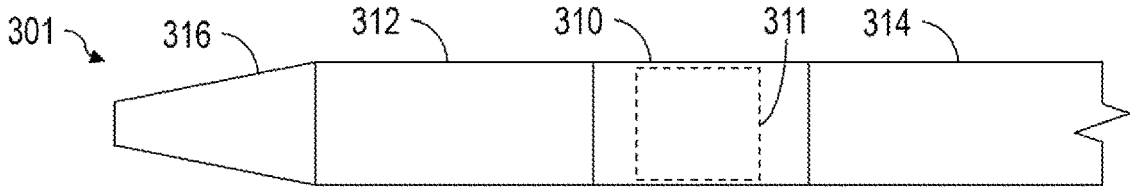
FIGS. 2-4 are schematic views of at least a portion of an example implementation of apparatus at different stages of assembly operations according to one or more aspects of the present disclosure.
Figure 3:
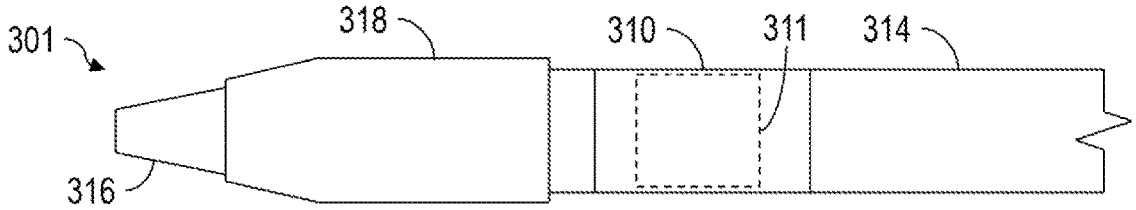
Figure 4:
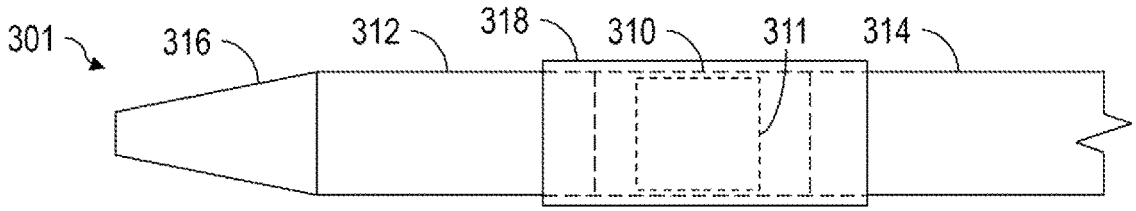

FIGS. 2-4 are schematic side views of the downhole tool 301 during different stages of assembly operations according to one or more aspects of the present disclosure. A conical member 316 may be temporarily connected to the housing portion 312 to facilitate placement of an external sleeve 318 about the sensor section 310 and proximate portions of the housing portions 312, 314. That is, positioning the external sleeve 318 on the conical member 316 radially expands (or stretches) the external sleeve 318 so that the external sleeve 318 can then be pulled onto the sensor section 310, including overlapping the proximate ends of the housing portions 312, 314. Lubrication may be used to reduce friction between the external sleeve 318 and the conical member 316, the sensor section 310, and the housing portions 312, 314. The conical member 316 may then be disconnected from the housing portion 312.

The external sleeve 318 may be or comprise a thin walled, cylindrically shaped elastomer having a thickness that may be less than a millimeter, but may also be thicker as long as it remains sufficiently acoustically transparent for the sensor signal. Acoustic transparency can also be obtained by using a cylinder wall thickness that corresponds to a fraction of the wavelength (e.g., ¼, ½, ¾, or other fractions) of the acoustic signal in the material of the external sleeve 318. The external sleeve 318 may be formed by molding a rubber compound into an intended shape. Example materials of the external sleeve 318 include hydrogenated acrylonitrile butadiene rubber (HNBR), fluoroelastomer (FKM), and perfluoroelastomer (FFKM), among others. An inner radius of the external sleeve 318 may be slightly smaller than an outer radius of the housing portions 312, 314 and/or the sensor section 310 so that the external sleeve constantly applies a radially inward force on the sensor section 310 and the housing portions 312, 314.

Figure 5:
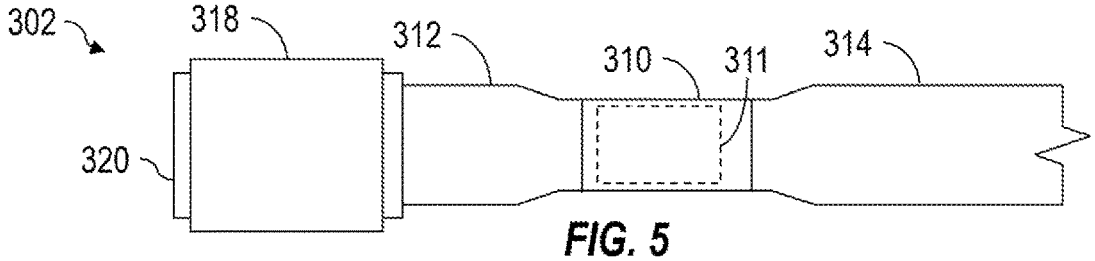
FIGS. 5-7 are schematic views of at least a portion of another example implementation of apparatus at different stages of assembly operations according to one or more aspects of the present disclosure.
Figure 6:
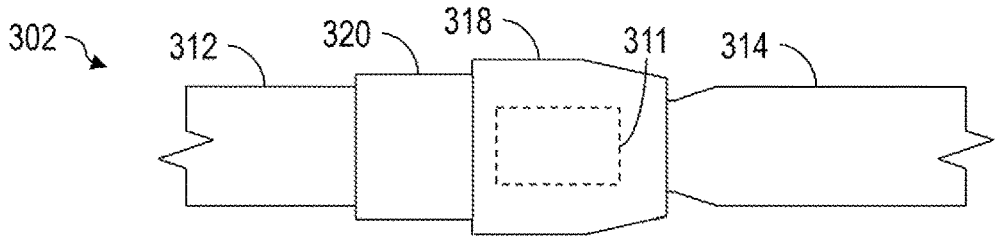
Figure 7:
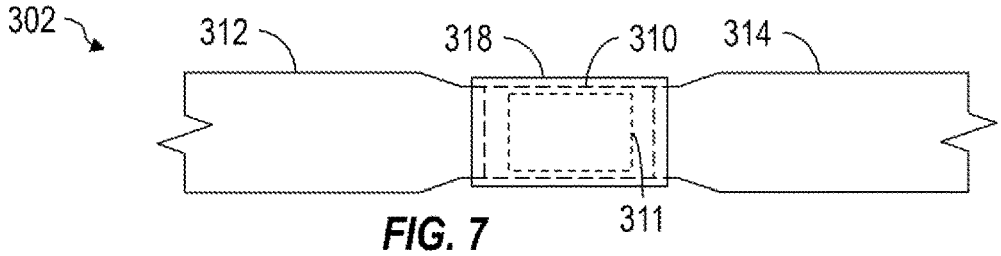

FIGS. 5-7 are schematic side views of the downhole tool 302 during different stages of assembly operations according to one or more aspects of the present disclosure. Instead of using the conical member 316 to facilitate placement of the external sleeve 318 about the housing portions 312, 314 and the sensor section 310, the conical member 316 may be used to facilitate placement of the external sleeve 318 onto a rigid tubular member 320, which may maintain the external sleeve 318 in a radially expanded (or stretched) state. An inner diameter of the rigid tubular member 320 is larger than an outer diameter of the housing portions 312, 314 and the sensor section 310. The rigid tubular member 320 with the external sleeve 318 may be disposed about the sensor section 310, and the external sleeve 318 may then be extracted from the rigid tubular member 320 onto the sensor section 310. The external sleeve 318 may then radially contract (or shrink) and contact the sensor section 310 and the adjacent ends of the housing portions 312, 314. Lubrication may be used to reduce friction between the external sleeve 318 and the conical member 316, the rigid tubular member 320, the sensor section 310, and the housing portions 312, 314. The rigid tubular member 320 may permit installation of the external sleeve 318 onto a sensor section 310 having an outer diameter that is smaller than, similar to, or larger than the adjacent housing portions 312, 314.

As described above, the external sleeve 318 may be formed from an elastic material that can permit the external sleeve 318 to be radially expanded (or stretched) for installation around the sensor section 310. Other external sleeves within the scope of the present disclosure may instead comprise a material (e.g., a polymer) that deforms (i.e., radially contracts or shrinks) upon increase of temperature, thereby causing the circumference of the external sleeve to decrease in the radially inward direction such that the external sleeve compresses against an outer surface of the sensor section 310 and the adjacent ends of the housing portions 312, 314.

For example, fluorinated ethylene propylene (FEP), a shape-memory alloy (SMA), and other heat-shrink materials may be used to form the external sleeve. Rigid materials, such as metal, bulk metallic glass (BMG), polyetheretherketone (PEEK), polytetrafluoroethylene (PTFE), and other hard polymers, may also be used to form the external sleeve. In FIGS. 8-30, the downhole tools 401-406, 408-422 each include an external sleeve 319, 458, 460, 466, 475, 477, 479 that may be formed from an elastomer (e.g., as with the external sleeve 318 described above), a heat-shrink material, or a rigid material. In each instance, however, the material forming the external sleeve 319, 458, 460, 466, 475, 477, 479 is sufficiently acoustically transparent to pass acoustic signals emitted and received by the sensor 311. Such external sleeves, or at least the portion of the external sleeve that is in front of the acoustic sensor, are also of sufficient homogeneous thickness to permit well-conditioned acoustic signals and avoid destructive spectral components.

An external sleeve comprising a heat-shrink material may not be first stretched in a radially outward direction, because its initial inside diameter can be larger than the largest diameter of the sensor section 310 and the housing portions 312, 314. After the external sleeve is disposed around the sensor section 310 and adjacent ends of the housing portions 312, 314, the external sleeve is subjected to heat to cause the external sleeve to decrease in a radially inward direction, such that the external sleeve compresses against outer surfaces of the sensor section 310 and the housing portions 312, 314.

Figure 8:
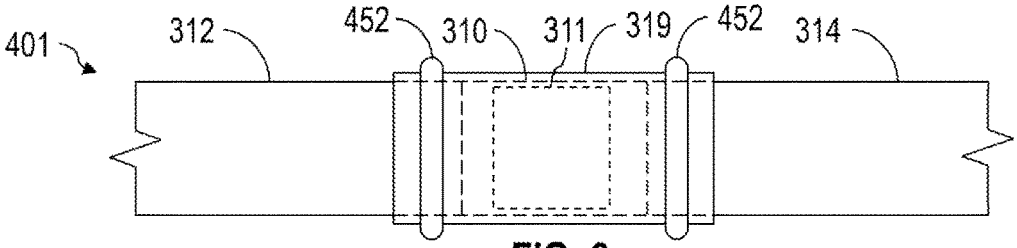
FIG. 8 is a schematic view of at least a portion of an example implementation of apparatus according to one or more aspects of the present disclosure.
Figure 9:
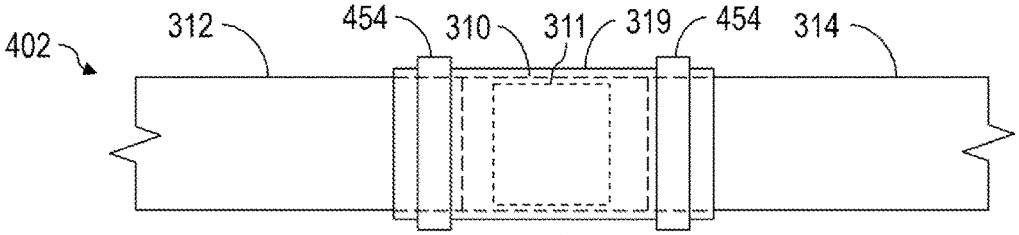
FIG. 9 is a schematic view of at least a portion of an example implementation of apparatus according to one or more aspects of the present disclosure.

To increase the sealing performance of each of the external sleeves described above, the external sleeve may be clamped against the outer surfaces of the housing portions 312, 314 adjacent the sensor section 310. For example, FIG. 8 is a schematic side view of the downhole tool 401, which comprises radial fasteners 452 that clamp the external sleeve 319 against outer surfaces of the housing portions 312, 314. Similarly, FIG. 9 is a schematic side view of the downhole tool 402, which comprises radial fasteners 454 that clamp the external sleeve 319 against outer surfaces of the housing portions 312, 314.

Each fastener 452, 454 may have a ring-shaped structure. As shown in FIG. 8, the ring-shaped fasteners 452 may have a circular or otherwise oval cross-sectional shape. As shown in FIG. 9, the ring-shaped fasteners 454 may have a square or otherwise rectangular cross-sectional shape. The fasteners 452, 454 may be formed from an SMA such that temporarily or permanently increasing the temperature of the fasteners 452, 454 from ambient to elevated temperature for some SMA alloys (e.g., via heat gun, oven baking, and/or other means), or such that increasing the temperature from below-ambient or subzero temperatures to ambient or slightly elevated temperatures for other types of SMA-alloys (e.g., by rapidly installing after removing from liquid nitrogen storage, and/or other means), deforms the fasteners 452, 454 (i.e., changes their crystalline arrangement) so that each fastener 452, 454 decreases in circumference/radius and thereby applies a radially inward force compressing the external sleeve 319 against outer surfaces of the housing portions 312, 314. Although the downhole acoustic measurement tools 401, 402 are shown comprising one fastener 452, 454 clamping each end of the external sleeve 319, two or more fasteners 452, 454 may be used to clamp each end of the external sleeve 319.

Compressing the external sleeve 319 against the housing portions 312, 314 forms (or contributes to) a fluid seal between the external sleeve 319 and the housing portions 312, 314. Thus, the external sleeve 319 and the fasteners 452, 454 may collectively form a fluid seal assembly of each downhole tool 401, 402.

Figure 10:
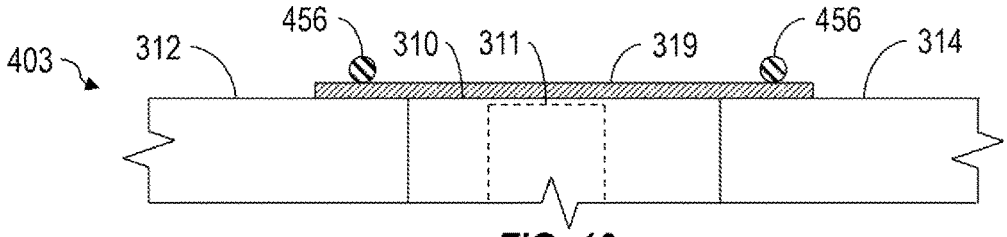
FIGS. 10-12 are side sectional views of a portion of the apparatus shown in FIGS. 8 and 9 at different stages of assembly operations according to one or more aspects of the present disclosure.
Figure 11:
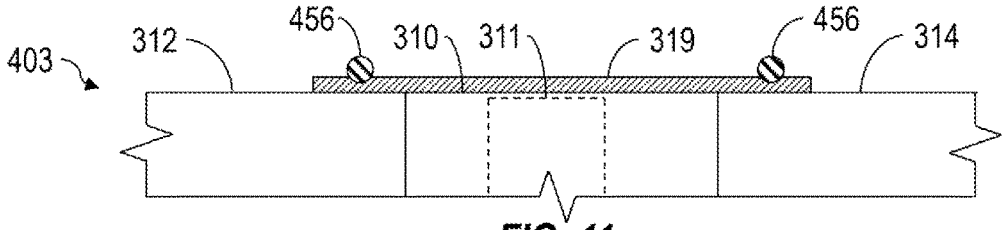
Figure 12:
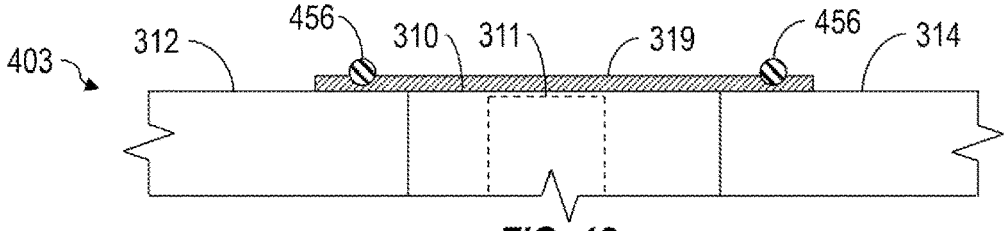

FIGS. 10-12 are schematic sectional views of the downhole tool 403 during different stages of assembly operations according to one or more aspects of the present disclosure. The downhole acoustic measurement tool 403 may be an example implementation of and comprise one or more features and/or modes of operation of one or more of the downhole tools 401, 402 shown in FIGS. 8 and 9, including where indicated by common reference numerals. For example, the downhole tool 403 may comprise fasteners 456 having one or more features and/or modes of operation of the fasteners 452, 454.

The temperature of the fasteners 456 may be increased in a plurality of steps to compress the external sleeve 319 against outer surfaces of the housing portions 312, 314. For example, the fasteners 456 may be first positioned in an intended axial position along the downhole tool 403 and the external sleeve 319, as shown in FIG. 10. Thereafter, the fasteners 456 may be heated to an initial temperature to cause the fasteners 456 to apply a relatively small radially inward force to the external sleeve 319 to pre-set the fasteners 456 in the intended axial position, as shown in FIG. 11. The fasteners 456 may then be heated to a second (i.e., a higher) temperature to cause the fasteners 456 to apply an increased radially inward force to the external sleeve 319 to further compress the external sleeve 319 against the outer surfaces of the housing portions 312, 314 to physically clamp the external sleeve 319 in position and increase the fluid seal between the external sleeve 319 and the outer surfaces of the housing portions 312, 314, as shown in FIG. 12.

FIGS. 13-23 are schematic sectional views of portions of the downhole tools 404-406, 408-416, respectively, each of which may be example implementation of and comprise one or more features and/or modes of operation of one or more of the downhole tools 401-403 shown in FIGS. 8-12, including where indicated by common reference numerals.

Figure 13:
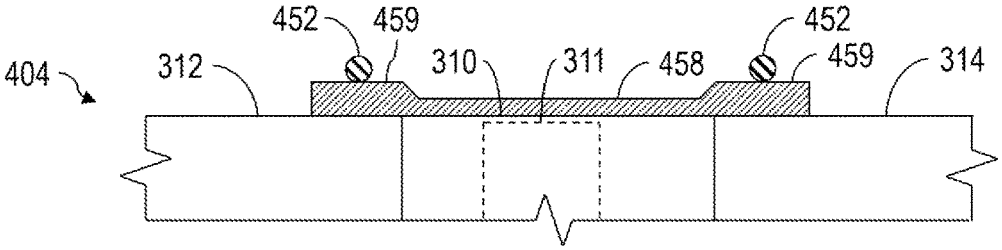
FIGS. 13-24 are side sectional views of a portion of example implementations of the apparatus shown in FIGS. 8 and 9 according to one or more aspects of the present disclosure.
Figure 14:
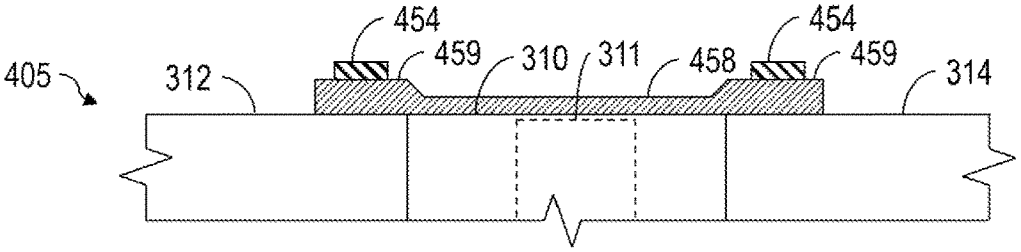

As shown in FIG. 13, the external sleeve 458 of the downhole tool 404 may comprise thicker sections 459 extending in a radially outward direction and located between the fasteners 452 (from FIG. 8) and outer surfaces of the housing portions 312, 314. As shown in FIG. 14, the external sleeve 458 of the downhole tool 405 may also comprise the thicker sections 459 located between fasteners 454 (from FIG. 9) and outer surfaces of the housing portions 312, 314. The thicker sections 459 of the external sleeves 458 shown in FIGS. 13 and 14 may prevent or inhibit the fasteners 452, 454 from puncturing the external sleeve 458 when the fasteners 452, 454 compress the external sleeve 458 against the outer surfaces of the housing portions 312, 314.

Figure 15:
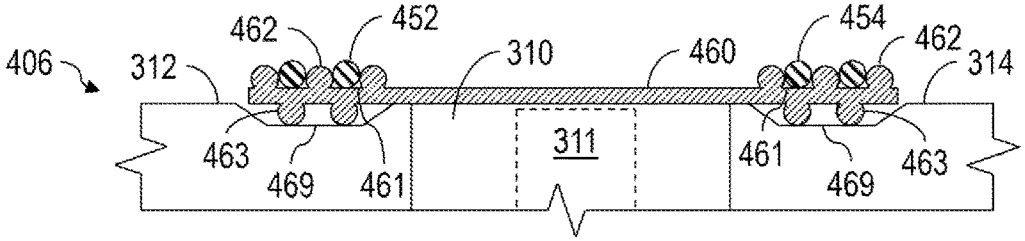

As shown in FIG. 15, the external sleeve 460 of the downhole tool 406 may comprise circumferential profiles 461, 462 for maintaining the fasteners 452 (from FIG. 8) at predetermined axial locations. The downhole tool 406 may comprise a plurality of the fasteners 452 on each end of the external sleeve 460, such as to improve the fluid seal between the external sleeve 460 and the outer surfaces of the housing portions 312, 314.

The circumferential profiles 461, 462 may comprise circumferential grooves 461 facing in a radially outward direction for accommodating the fasteners 452 and maintaining the fasteners 452 at predetermined axial locations along the external sleeve 460. The circumferential profiles 461, 462 may also or instead comprise circumferential ridges 462 extending in a radially outward direction for accommodating the fasteners 452 therebetween (i.e., on opposing sides of the fasteners 452) and for maintaining the fasteners 452 at the predetermined axial locations along the external sleeve 460.

The external sleeve 460 may also or instead have a plurality of thicker sections 463 each extending in a radially inward direction and located between the fasteners 452 and the outer surfaces of the housing portions 312, 314. The thicker sections 463 may prevent or inhibit the fasteners 452 from puncturing the external sleeve 460 when the fasteners 452 compress the external sleeve 460 against the outer surfaces of the housing portions 312, 314. In addition, when the thicker sections 463 under the fasteners 452 are radially compressed, they form an axial sealing along the interface between the sleeve 460 and the housing portions 312, 314, perhaps in a manner that may be more effective and reliable than the homogeneous thicker sections 459 shown in FIGS. 13 and 14.

The thicker sections 463 of the external sleeve 460 may each be disposed within a corresponding circumferential groove (or channel) 469 extending along the outer surfaces of the housing portions 312, 314. The thicker sections 463 and the circumferential grooves 469 may collectively facilitate positioning of the external sleeve 460 at an intended axial location around the sensor section 310.

Figure 16:
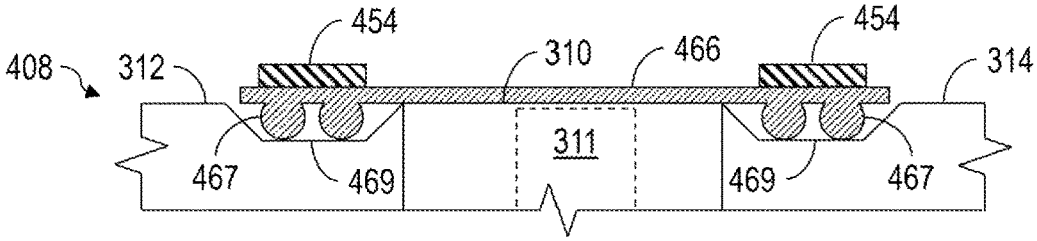

As shown in FIG. 16, the thicker sections 467 of the external sleeve 466 of the downhole tool 408 may each be disposed within a corresponding circumferential groove (or channel) 469 extending along the outer surfaces of the housing portions 312, 314. The thicker sections 467 and the circumferential groove 469 may collectively facilitate positioning of the external sleeve 466 at an intended axial location around the sensor section 310.

Although the thicker sections 463, 467 in FIGS. 15 and 16 are depicted with a generally circular cross-sectional shape, other cross-sectional shapes are also within the scope of the present disclosure. For example, the cross-sectional shapes of the thicker sections 463, 467 may be triangular, rectangular, and/or other geometries.

Figure 17:
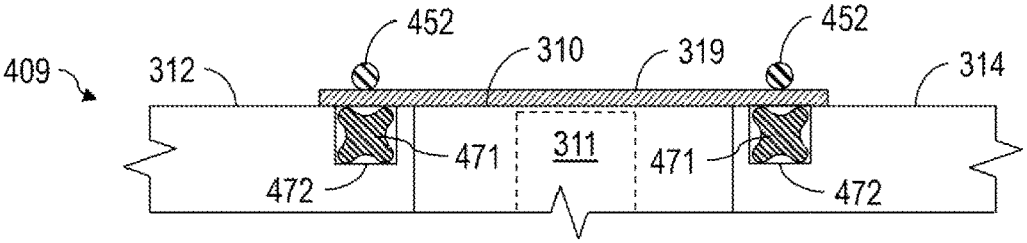

As shown in FIG. 17, the outer surfaces of the housing portions 312, 314 of the downhole tool 409 may each comprise a circumferential channel (or groove) 472 containing a gasket 471. Each gasket 471 may have an X-shaped cross-sectional profile, such as may be known in the art as an X-ring. A fluid seal may be formed between the external sleeve 319 and the gaskets 471 as the fasteners 452 compress the external sleeve 319 against the gaskets 471.

The downhole environment may contain highly corrosive hydrogen-based fluids and gases that can attack metal fasteners and may result in the failure of the material forming such fasteners. To delay and/or prevent such corrosion, the fasteners can be protected from the outside environment by fluidly isolating (e.g., covering) the fasteners from the external space using an external sleeve according to one or more aspects of the present disclosure. This can be achieved in different ways.

Figure 18:
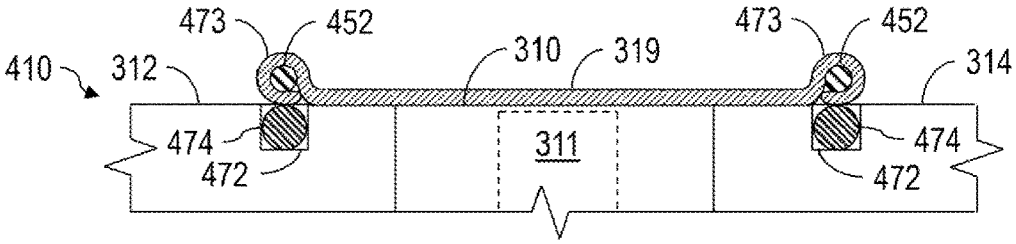

As shown in FIG. 18, the fasteners 452 of the downhole tool 410 may be rolled into the ends 473 of the external sleeve 319, such that one end 473 of the external sleeve 319 is wrapped around one of the fasteners 452 and the opposing end 473 of the external sleeve 319 is wrapped around another one of the fasteners 452, thereby fluidly isolating the fasteners 452 from the external space. The outer surfaces of the housing portions 312, 314 may have the channels 472 of FIG. 17, each containing a gasket 474. A fluid seal may be formed between the external sleeve 319 and each of the gaskets 474 when the fasteners 452 compress the external sleeve 319 against the gaskets 474. The gasket 474 may also have non-circular cross-sectional shapes, such as a square or other rectangular shape, or the X-rings 471 shown in FIG. 17.

Figure 19:
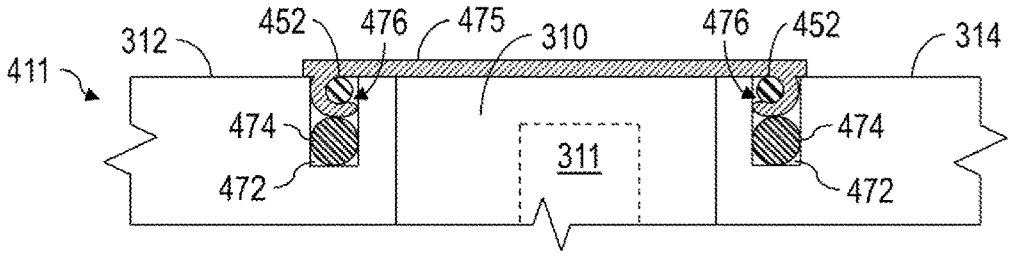

As shown in FIG. 19, each end of the external sleeve 475 of the downhole tool 411 may have an internal circumferential groove (or receptacle) 476 that contains a corresponding one of the fasteners 452, thereby fluidly isolating the fasteners 452 from the external space. The outer surfaces of the housing portions 312, 314 may have the channels 472 of FIG. 17, each containing a gasket 474. A fluid seal may be formed between the external sleeve 319 and each of the gaskets 474 when the fasteners 452 compress the external sleeve 319 against the gaskets 474. The gaskets 474 may also have non-circular cross-sectional shapes, such as a square or other rectangular shape, or the X-rings 471 shown in FIG. 17.

Figure 20:
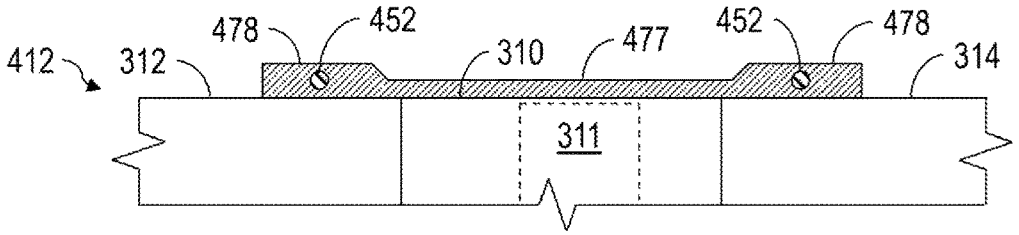
Figure 21:
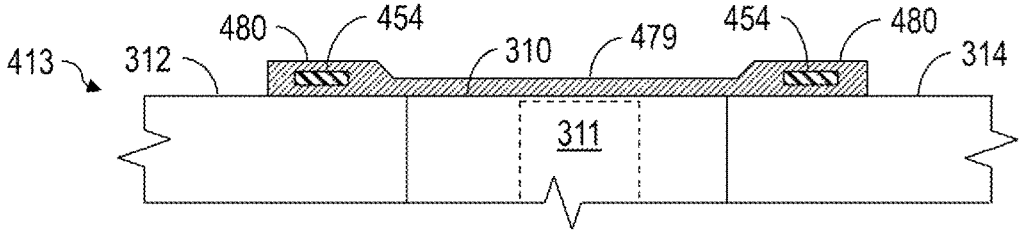

As shown in FIG. 20, the fasteners 452 of the downhole tool 412 may be embedded within (e.g., molded into) the material forming the ends 478 of the external sleeve 477, such that the material of the external sleeve 477 fluidly isolates the fasteners 452 from the external space. The downhole tool 413 shown in FIG. 21 similarly has fasteners 454 embedded within the material forming the ends 480 of the external sleeve 479, such that the material of the external sleeve 479 fluidly isolates the fasteners 454 from the external space. The ends 478, 480 of the external sleeves 477, 479 may be thickened, such as to facilitate fluid isolation of the fasteners 452, 454 from the external space. The thickened ends 478, 480 of the external sleeves 477, 479 may also aid in preventing or inhibiting the fasteners 452, 454 from puncturing the external sleeves 477, 479 when the fasteners 452, 454 compress the external sleeves 477, 479 against the outer surfaces of the housing portions 312, 314.

Figure 22:
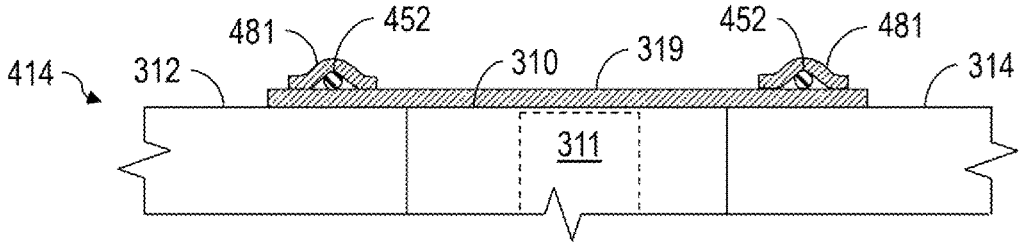
Figure 23:
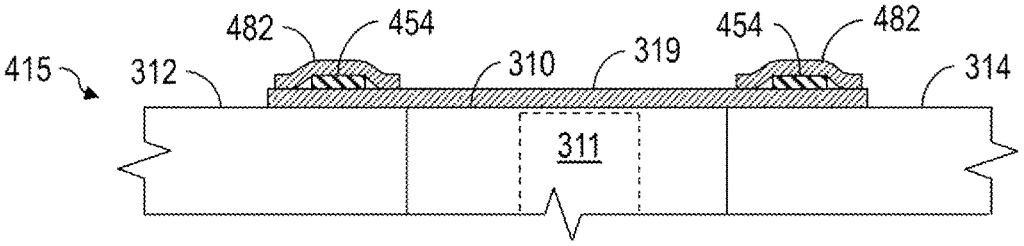

As shown in FIG. 22, the fasteners 452 of the downhole tool 414 may each be covered by a corresponding additional sleeve (or layer) 481 of an elastomer, a heat-shrink material, or a rigid material (e.g., as described above with respect to external sleeve 319), such that the fasteners 452 are located between the external sleeves 319, 481 and, thereby, fluidly isolated from the external space. In a like manner, as shown in FIG. 23, the fasteners 454 of the downhole tool 415 may be covered by a similar additional sleeve 482 such that the fasteners 454 are fluidly isolated from the external space. The material forming the additional sleeves 481, 482 may comprise the material forming the external sleeve 319 or another material. The additional sleeves 481, 482 may be disposed about and extend circumferentially around the fasteners 452, 454 and the external sleeve 319 using one or more of the methods for disposing the external sleeve 318 around the sensor section 310 and housing portions 312, 314 described above, including using one or more of the devices 316, 320 described above and/or heating the additional sleeves 481, 482 to cause the additional sleeves 481, 482 to radially contract (or shrink) to form a fluid seal around the fasteners 452, 454.

Figure 24:
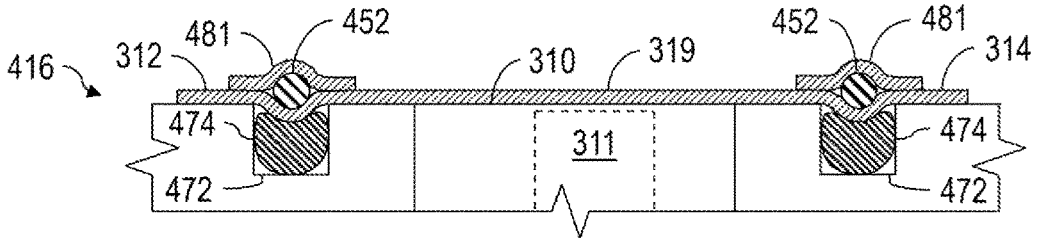

As shown in FIG. 24, the downhole tool 416 is similar to the downhole tool 414 of FIG. 22, except that the outer surfaces of the housing portions 312, 314 have the circumferential grooves 472 of FIG. 17, each containing a gasket 474. A fluid seal may be formed between the external sleeve 319 and each gasket 474 when the fasteners 452 compress the external sleeve 319 against the gaskets 474. The gaskets 474 may also have non-circular cross-sectional shapes, such as a square or other rectangular shape, or the X-rings 471 shown in FIG. 17.

Radial fasteners used with downhole tools according to one or more aspects of the present disclosure may be elastic or heat-shrink fasteners. The main difference between a heat-shrink fastener and an elastic fastener is that the range of diameter change of the heat-shrink fastener is relatively small, whereas radial elastic fasteners apply a stable compressive force over a relatively larger range of diameters, although the compressive force is relatively smaller than that of a heat-shrink fastener. Elastic fasteners can also follow diameter variations of an external sleeve under pressure change and can apply a stable compressive force.

Figure 25:
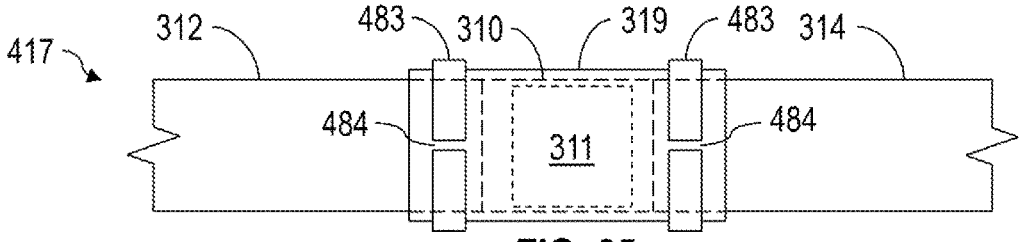
FIG. 25 is a schematic view of at least a portion of an example implementation of apparatus according to one or more aspects of the present disclosure.

As shown in FIG. 25, the downhole tool 417 comprises elastic radial fasteners 483 each extending circumferentially around the external sleeve 319 and compressing the external sleeve 319 against a corresponding housing portion 312, 314. Each fastener 483 may have a ring geometry. For example, each fastener 483 may be or comprise an elongated member (e.g., a bar, a sheet, etc.) formed of a flexible material (e.g., a metal, an elastomer, etc.) that is bent or otherwise curved to form a ring. Each fastener 483 may thus comprise a disconnected (or discontinuous) portion 484. The fasteners 483 may have rectangular or round cross-sectional profiles. The fasteners 483 may be expanded in the radially outward direction, disposed around a corresponding end of the external sleeve 319, and then permitted to elastically contract (or shrink) in the radially inward direction, thereby applying a radially inward force to compress the external sleeve 319 against outer surfaces of the housing portions 312, 314. The downhole tool 417 may also comprise more than one fastener 483 compressing each end of the external sleeve 319 against the housing portions 312, 314.

Figure 26:
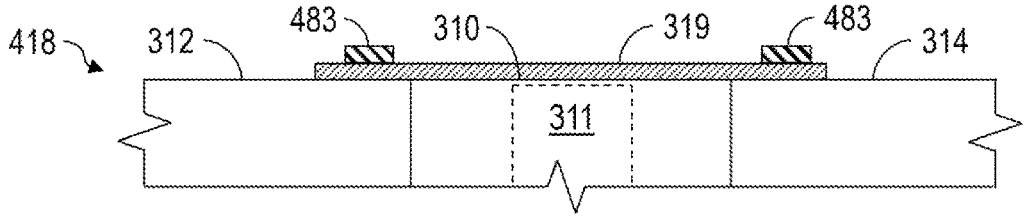
FIGS. 26-30 are side sectional views of a portion of example implementations of the apparatus shown in FIG. 25 according to one or more aspects of the present disclosure.
Figure 27:
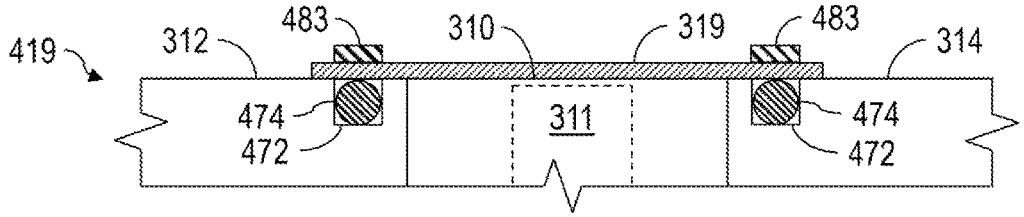
Figure 28:
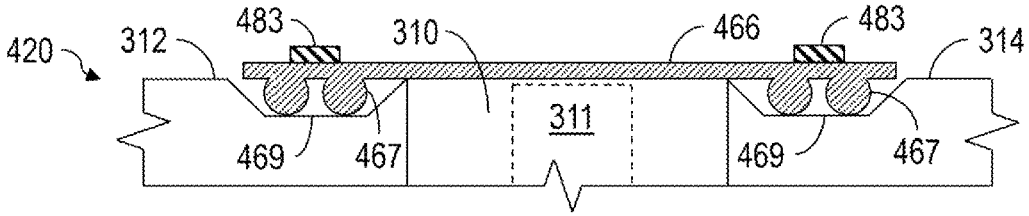

The downhole tools 418-420 shown in FIGS. 26-28 are example implementations of the downhole tool 417 shown in FIG. 25, including where indicated by common reference numerals. As shown in FIG. 26, the fasteners 483 of the downhole tool 418 compress the external sleeve 319 against outer surfaces of the housing portions 312, 314. As shown in FIG. 27, the fasteners 483 of the downhole tool 419 compress the external sleeve 319 against the gaskets 474 contained in the circumferential grooves 472 in the outer surfaces of the housing portions 312, 314. As shown in FIG. 28, the fasteners 483 of the downhole tool 420 compress the thicker sections 467 of the external sleeve 466 against the outer surfaces of the housing portions 312, 314. As also described above, the thicker sections 467 may each be disposed within a corresponding circumferential groove (or channel) 469 extending along the outer surfaces of the housing portions 312, 314. The thicker sections 467 and the circumferential grooves 469 may collectively facilitate positioning of the external sleeve 466 at an intended axial location around the sensor section 310.

An external sleeve according to one or more aspects of the present disclosure may not provide enough mechanical strength in the long term, such as when abrasive surfaces, sharp edges, and/or impact shock hazards are present. However, bonding between the external sleeve and the one or more sensors 311 within the sensor section 310 of a downhole acoustic measurement tool, as well as sufficient acoustic transparency of the external sleeve, are optimal among various tested solutions. Thus, to combine mechanical strength and acoustic transparency, a plurality of sleeves may be used, as described below.

Figure 29:
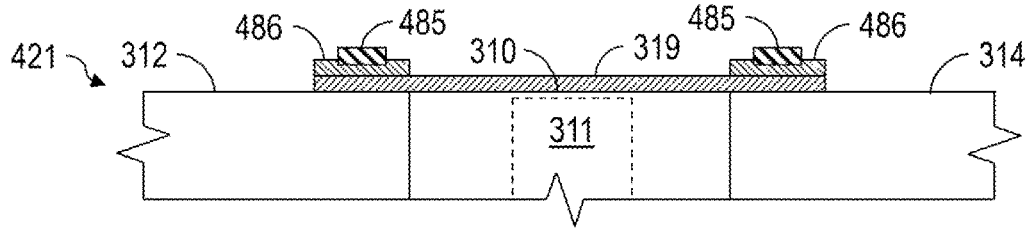
Figure 30:
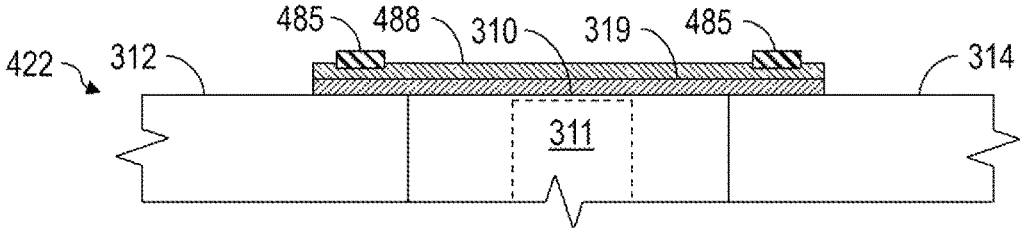

FIG. 29 is a schematic sectional view of a portion of the downhole tool 421, which comprises a plurality of sleeves 319, 486. FIG. 30 is a schematic sectional view of a portion of the downhole tool 422, which comprises a plurality of sleeves 319, 488. The outer sleeves 486, 488 may be formed of an elastomer, a heat-shrink material, or a rigid material, as described above with respect to external sleeve 319. The downhole tools 421, 422 are example implementations of and comprise one or more features and/or modes of operation of one or more of the downhole tools described above, including where indicated by common reference numerals.

As shown in FIG. 29, the outer sleeves 486 cover the inner sleeve 319 except for around the sensor section 310. As shown in FIG. 30, the outer sleeve 488 covers the entire inner sleeve 319, including around the sensor section 310. Each downhole tool 421, 422 further comprises fasteners 485 extending circumferentially around and compressing the inner and outer sleeves 319, 486, 488 against outer surfaces of the housing portions 312, 314, thereby forming a fluid seal between the outer surfaces of the housing portions 312, 314 and the external sleeve 318. The fasteners 485 may be, for example, the fasteners 452, 454, or 483 described above.

Figure 31:
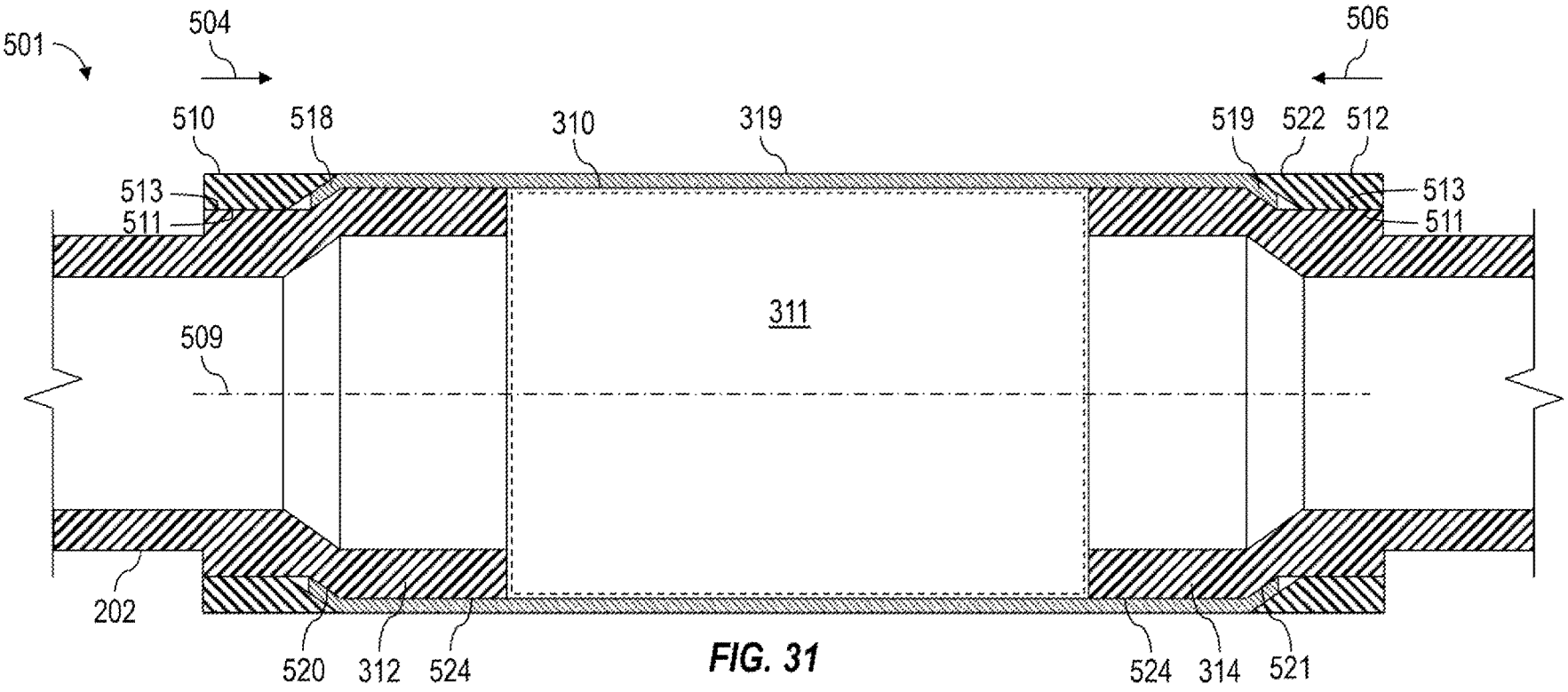
FIGS. 31-36 are side sectional views of portions of example implementations of apparatus according to one or more aspects of the present disclosure.

The present disclosure is further directed to a fluid seal assembly comprising axial compression fasteners configured to compress an external sleeve against surfaces of a housing of a downhole tool. FIG. 31 is a schematic sectional view of at least a portion of an example implementation of a downhole tool 501 comprising the external sleeve 319 and axial compression fasteners 510 configured to compress the external sleeve 319 against a housing 202 of the downhole acoustic measurement tool 501 according to one or more aspects of the present disclosure. The downhole tool 501 may be an example implementation of and comprise one or more features and/or modes of operation of one or more of the downhole tools described above, including where indicated by common reference numerals.

The downhole tool 501 comprises first and second fasteners 510, 512 formed of steel and/or other metals. The first fastener 510 has a ring geometry and is configured to be disposed circumferentially around the first housing portion 312. The first fastener 510 comprises internal threads 511 configured to engage external threads 513 of the first housing portion 312. Rotation of the first fastener 510 causes the first internal threads 511 to engage the first external threads 513 and thereby cause the first fastener 510 to move axially in a first direction, as indicated by arrow 504, and thereby apply a first axial force to a first end 518 of the external sleeve 319 to compress the first end 518 against a conical outer surface 520 of the first housing portion 312.

The second fastener 512 has a ring geometry and is configured to be disposed circumferentially around the second housing portion 314. The second fastener 512 comprises internal threads 511 configured to engage external threads 513 of the second housing portion 314. Rotation of the second fastener 512 causes the internal threads 511 to engage the external threads 513 and thereby cause the second fastener 512 to move axially in a second direction, as indicated by arrow 506, and thereby apply a second axial force to a second end 519 of the external sleeve 319 to compress the second end 519 of the external sleeve 319 against a conical surface 521 of the second housing portion 314.

The external sleeve 319 and the fasteners 510, 512 may collectively be or form a fluid seal assembly of the downhole tool 501. For example, compression of the first end 518 of the external sleeve 319 against the first surface 520 by the first fastener 510 forms a first fluid seal between the surface 520 and the first end 518 of the external sleeve 319, and compression of the second end 519 of the external sleeve 319 against the surface 521 by the second fastener 512 forms a second fluid seal between the surface 521 and the second end 519 of the external sleeve 319.

Figure 32:
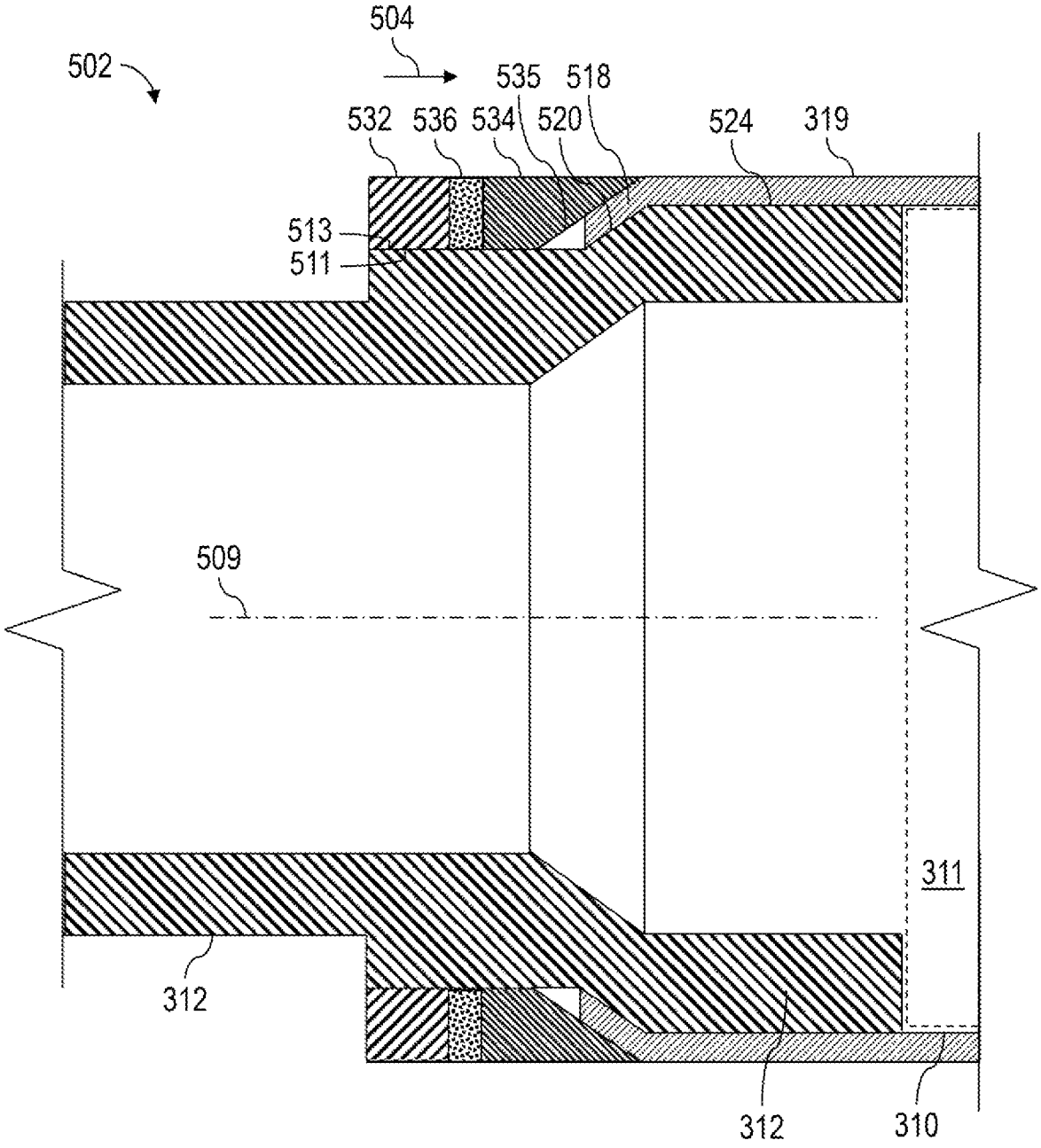

FIG. 32 is a schematic sectional view of a portion of an example implementation of a downhole tool 502 comprising the external sleeve 319 and axial compression fasteners 532 configured to compress the external sleeve 319 against the housing portion 312 according to one or more aspects of the present disclosure. The downhole tool 502 may be an example implementation of and comprise one or more features and/or modes of operation of one or more of the downhole tools described above, including where indicated by common reference numerals.

The fasteners 532 each have a ring geometry and are configured to be disposed circumferentially around a corresponding one of the housing portions 312, 314. The fasteners 532 may be identical, such that just one is shown in FIG. 32. The shown fastener 532 comprises internal threads 511 configured to engage external threads 513 of the housing portion 312. Rotation of the fastener 532 causes the internal threads 511 to engage the external threads 513 and thereby cause the fastener 532 to move axially, as indicated by arrow 504, and thereby apply an axial force compressing the end 518 of the external sleeve 319 against an outer surface 520 of the housing portion 312. The outer surface 520 may be an outer conical surface or shoulder that expands radially outward relative to the central axis 509 along the axial direction 504. The material forming the fastener 532 may comprise a metal (e.g., steel).

The downhole tool 502 also comprises push members 534, 536 each having a ring geometry and configured to be disposed circumferentially around the housing portion 312 between the fastener 532 and the end 518 of the external sleeve 319. The push member 536 may be an axial spring member, whereas the push member 534 may be a metallic or otherwise rigid member. Rotation of the fastener 532 causes the internal threads 511 to engage the external threads 513 and thereby cause the fastener 532 to move axially, as indicated by the arrow 504, and thereby apply the axial force to the end 518 of the external sleeve 319, via the push members 534, 536, to compress the end 518 of the external sleeve 319 against the surface 520. The push member 534 has an inner conical surface 535 cooperative with the outer conical surface 520 of the housing portion 312. The push member 536 has a predetermined axial stiffness (e.g., spring constant, modulus of elasticity, etc.), such as may facilitate application and maintenance of a predetermined axial force by the fastener 532 to the intermediate member 534 and, thus, compress the end 518 of the external sleeve 319 against the surface 520 at the predetermined axial force.

Figure 33:
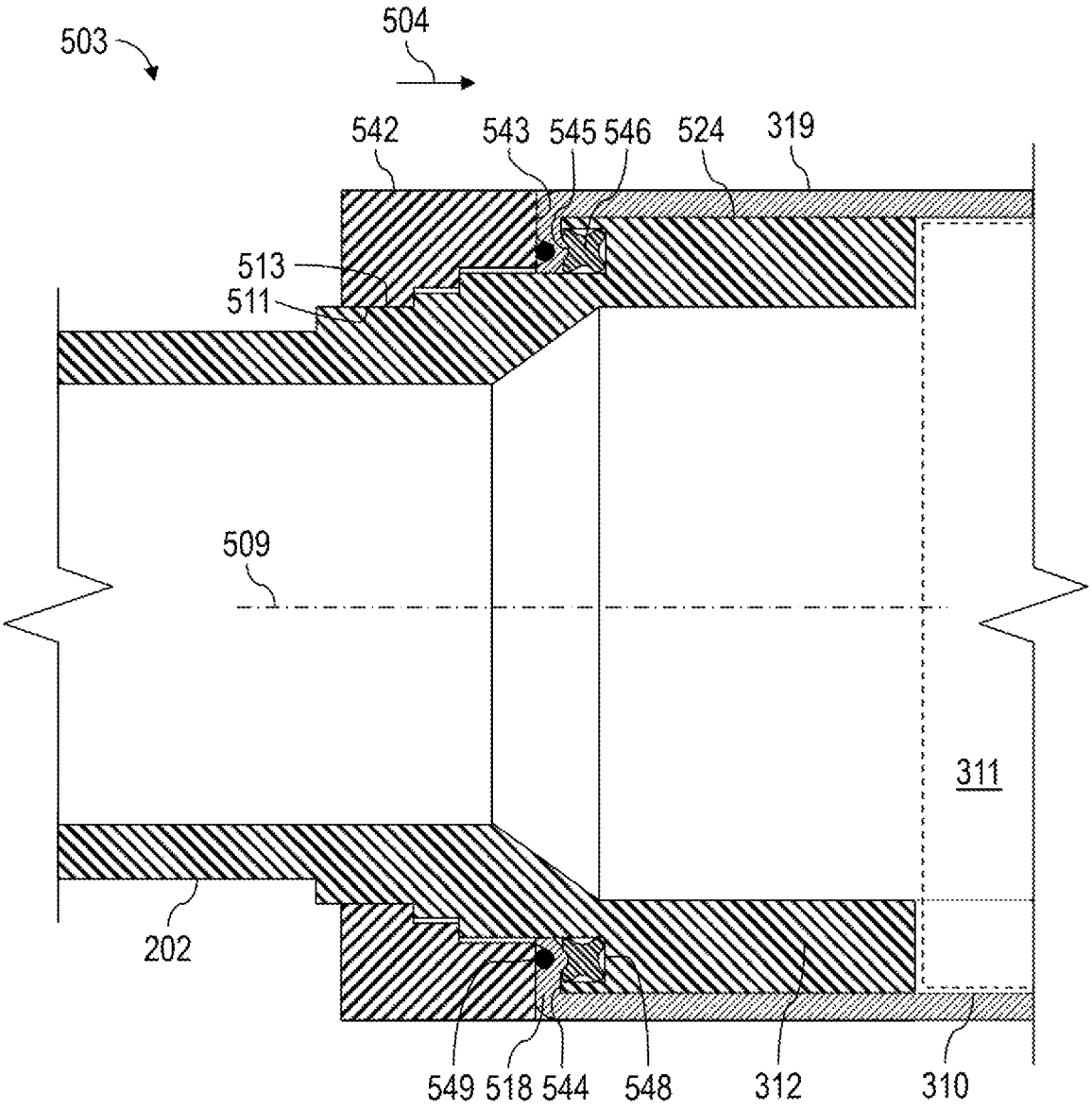

FIG. 33 is a schematic sectional view of a portion of an example implementation of a downhole tool 503 comprising the external sleeve 319 and axial compression fasteners 542 configured to compress the external sleeve 318 against the housing portions 312, 314 according to one or more aspects of the present disclosure. The downhole tool 503 may be an example implementation of and comprise one or more features and/or modes of operation of one or more of the downhole acoustic measurement tools described above, including where indicated by common reference numerals.

The fasteners 542 each have a ring geometry and are configured to be disposed circumferentially around a corresponding housing portion 312, 314. The fasteners 542 may be identical, such that just one is shown in FIG. 33. The shown fastener 542 comprises internal threads 511 configured to engage external threads 513 of the housing portion 312. Rotation of the fastener 542 causes the internal threads 511 to engage the external threads 513 and thereby cause the fastener 542 to move axially, as indicated by arrow 504, and thereby apply an axial force to and compress the end 518 of the external sleeve 319 against the housing portion 312. The material forming the fastener 542 may comprise a metal (e.g., steel).

The fastener 542 comprises a contact surface 543 and the housing portion 312 comprises a complementary (i.e., a corresponding or mating) surface 544. The surface 543 of the fastener 542 is configured to compress the end 518 of the external sleeve 319 against the surface 544 of the housing portion 312 as the fastener 542 moves axially in response to rotation. The surface 543 may be a lateral surface (or shoulder) that extends perpendicularly (or radially) outward relative to the central axis 509. The surface 544 may be a lateral surface (or shoulder) that extends perpendicularly (or radially) relative to the central axis 509. The surfaces 543, 544 may be parallel to each other.

The surface 544 may be at least partially defined by or otherwise comprise a circumferential profile 545 configured to seal against the end 518 of the external sleeve 319. A fluid seal may be formed between the end 518 of the external sleeve 319 and the circumferential profile 545 when the fastener 542 compresses the end 518 of the external sleeve 319 against the circumferential profile 545. The circumferential profile 545 may be defined by a gasket (or another fluid sealing element) 546 disposed within a circumferential groove 548 extending along the surface 544. The gasket 546 may comprise an X-shaped cross section defining the circumferential profile as a circumferential groove.

The downhole tool 503 also comprises an intermediate member (or push member) 549 having a ring geometry and configured to be disposed circumferentially around the housing portion 312 between the surface 543 of the fastener 542 and the surface 544 of the housing portion 312. Rotation of the fastener 542 causes the internal threads 511 to engage the external threads 513 and thereby cause the fastener 542 to move axially in the direction 504 and thereby (via the intermediate member 549) apply the axial force to and compress the end 518 of the external sleeve 319 against the surface 544. The intermediate member 549 may be a ring having a circular cross-sectional profile configured to compress the end 518 of the external sleeve 319 against and/or into the profile 545 to form the fluid seal between the end 518 of the external sleeve 319 and the circumferential profile 545. The material forming the intermediate member 549 may comprise a metal (e.g., steel), a polymer, or an elastomer.

Figure 34:
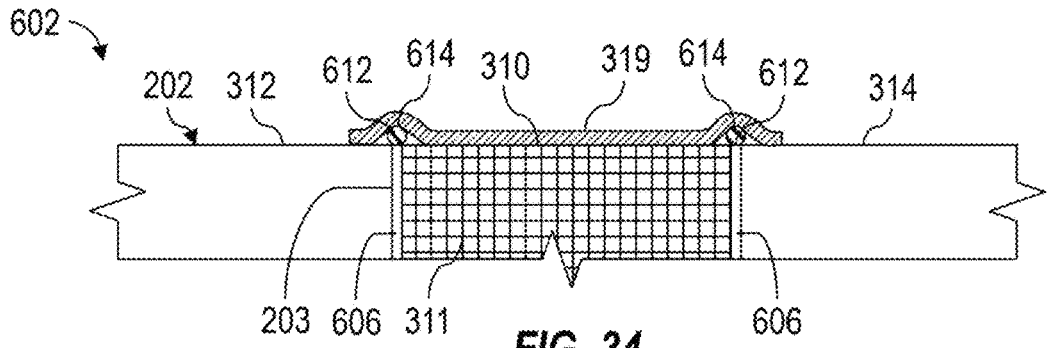
Figure 35:
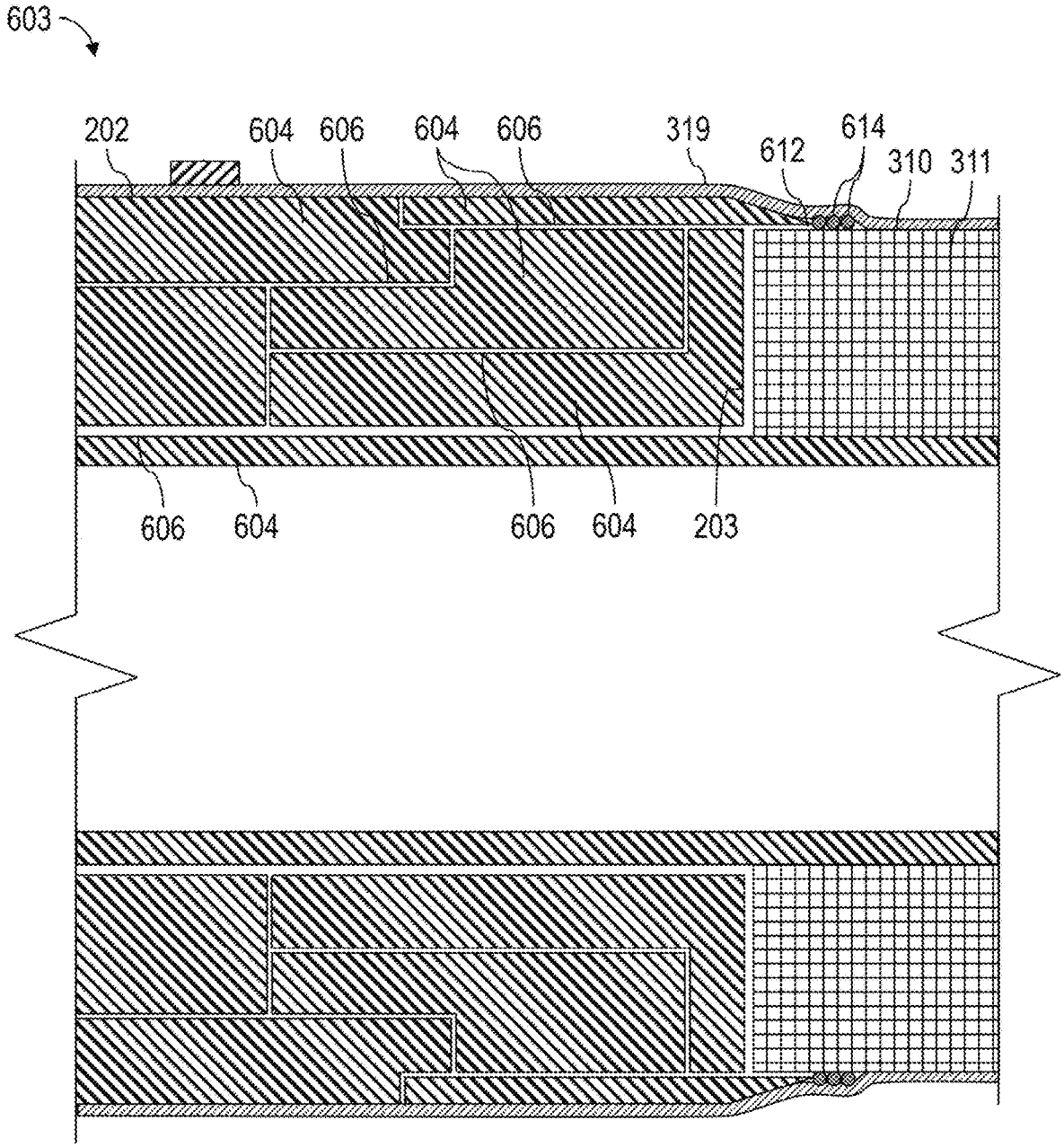

The present disclosure is further directed to an anti-extrusion filler disposed between an external sleeve and an outer surface of a housing of a downhole acoustic measurement tool. FIGS. 34 and 35 are schematic sectional views of a portion of example implementations of downhole tools 602, 603, respectively, each comprising an anti-extrusion filler according to one or more aspects of the present disclosure. The downhole tools 602, 603 may be example implementations of and comprise one or more features and/or modes of operation of one or more of the downhole tools described above, including where indicated by common reference numerals.

The downhole tools 602, 603 each comprise a housing 202 that includes the above-described housing portions 312, 314 and the sensor section 310 that includes an internal chamber 203 containing the sensor(s) 311. The housing portions 312, 314 may collectively define at least a portion of the internal chamber 203 containing the sensor(s) 311.

The housing portions 312, 314 and the sensor section 310 may have small clearances therebetween, thereby forming or otherwise defining gaps 606 therebetween. The gaps may collectively form (or operate as) one or more fluid pathways that extend between a space external to the downhole tools 602, 603 (i.e., an outer surface of the housing portions) and the internal chamber 203. One or more of the gaps 606 may terminate at one or more slots 612 extending along the outer surface of the housing 202.

The downhole tools 602, 603 further comprise the external sleeve 319 disposed circumferentially around the sensor section 310, including the internal chamber 203, and around ends of the housing portions 312, 314 adjacent the sensor section 310. The downhole tools 602, 603 further comprise a material 614 disposed internal to the sleeve 319 to further block entry of the wellbore fluid into the slots 612. For example, the material 614 may be one or more gaskets and/or a filler material 614 disposed along the slots 612 between the external sleeve 319 and the outer surface of the housing 202. The material 614 may be or comprise at least one of an epoxy, a silicone, a silicone rubber (e.g., room-temperature-vulcanizing (RTV) resin), a rubber or a polyetherimide.

The material 614 and the external sleeve 319 may collectively prevent the wellbore fluid from flowing into the internal chamber 203 via the gaps 606, thereby maintaining a pressure differential between a wellbore pressure within the wellbore and an internal pressure within the internal chamber 203 and the gaps 606. For example, the material 614 and the external sleeve 319 may be configured to inhibit the wellbore fluid from flowing from the outside of the housing 202 into the internal chamber 203 via the slots 612 and the gaps 606 when the downhole tool 602, 603 is conveyed within the wellbore. Thus, the chamber 203 and the gaps 606 may be maintained at the internal pressure (e.g., atmospheric pressure) that is lower than the wellbore pressure. A pressure differential may therefore form across the material 614 and the external sleeve 319, wherein the wellbore pressure is higher than the internal pressure within the chamber 203 and the gaps 606. The material 614 may be configured to be extruded into the gaps 606 via the slots 612 as a result of the pressure differential, thereby inhibiting the external sleeve 319 from being extruded into the gaps 606 via the slots 612 as a result of the pressure differential. The material 614 may, thus, be or form a sacrificial material (or member) configured to be extruded into the gaps 606 via the slots 612 by the pressure differential while preventing or inhibiting the external sleeve 319 from being extruded into gaps 606 and thereby maintaining the structural integrity of the external sleeve 319.

Figure 36:
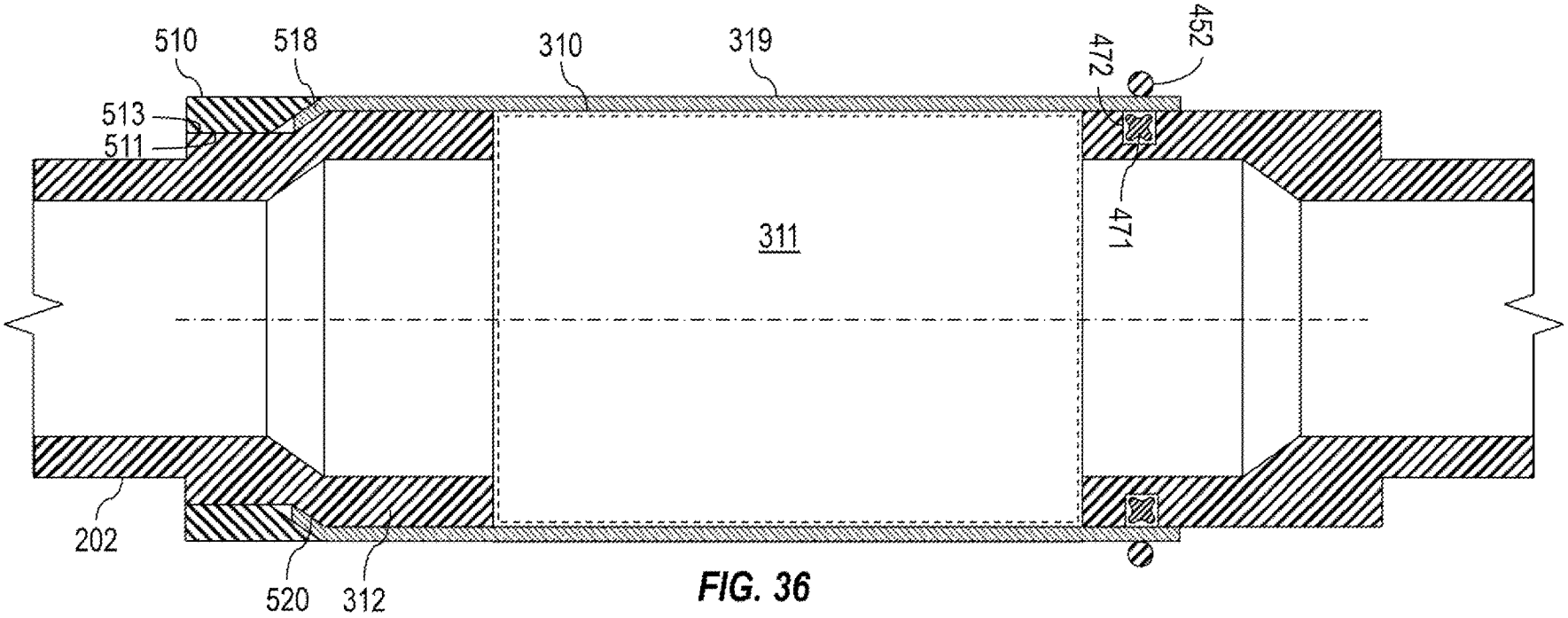

Other embodiments of the downhole tool can combine different sealing mechanisms on each end of the external sleeve 319. These sealing mechanisms can be any of the mechanisms described before. As an example, FIG. 36 depicts such an embodiment of the downhole tool. The downhole tool can be substantially similar to the one shown herein. The downhole tool can have a housing 202. The housing can have a portion 312 adjacent a sensor section 310 with one or more sensors 311. An external sleeve 319 can be disposed about the housing 202.

A first fastener 510 and a second fastener 452 may collectively engage the external sleeve to form a fluid seal assembly of the downhole tool. For example, compression of the first end 518 of the external sleeve 319 against the first surface 520 by the first fastener 510 forms a first fluid seal between the surface 520 and the first end 518 of the external sleeve 319. The first fastener can have internal threads 511 to engage external threads 513 on housing portion 312.

The fastener 452 can create a fluid seal between the external sleeve 319 and one or more gaskets when the second fastener 452 compress the external sleeve 319 against the gaskets. The gaskets may be X-rings 471, but can also have non-circular cross-sectional shapes, such as a square or other rectangular shape. The gaskets, such as X-rings 471 can be disposed in circumferential grooves 472 in the outer surfaces of the housing.

The Abstract at the end of this disclosure is provided to comply with 37 C.F.R. § 1.72 (b) to permit the reader to quickly ascertain the nature of the technical disclosure. It is submitted with the understanding that it will not be used to interpret or limit the scope or meaning of the claims.

What is claimed is:

1. An apparatus comprising:

a downhole tool comprising an acoustic sensor operable for emitting and receiving acoustic signals to perform downhole measurements; and a fluid seal assembly comprising:

a sleeve disposed circumferentially around the downhole tool, wherein the sleeve is sufficiently acoustically transparent to pass the emitted and received acoustic signals; and a first fastener and a second fastener each extending circumferentially around the sleeve proximate respective first and second ends of the sleeve;

wherein the first and second fasteners comprise a shape-memory alloy such that, as a result of increased temperature, circumferences of the first and second fasteners decrease, thereby causing the first and second fasteners to apply a radially inward force to the sleeve to compress the sleeve against an outer surface of the downhole tool.

2. The apparatus of claim 1 wherein:

a portion of the sleeve is disposed in front of the acoustic sensor;

other portions of the sleeve extend axially above and below the acoustic sensor; and at least the portion of the sleeve in front of the acoustic sensor is of homogeneous thickness.

3. The apparatus of claim 1 wherein the sleeve is formed of a heat-shrinkable polymer such that, as a result of temporary heat treatment, the sleeve compresses against the outer surface of the downhole tool or an elastomer such that the sleeve constantly compresses against the outer surface of the downhole tool, or the sleeve is formed of a rigid material.

4. The apparatus of claim 1 wherein the first fastener is a first type of fastener and the second fastener is a second type of fastener, and wherein the first fastener is different from the second fastener.

5. The apparatus of claim 1 wherein the first and second fasteners are elastomeric such that the first and second fasteners constantly compress the sleeve against the outer surface of the downhole tool.

6. The apparatus of claim 1 wherein:

the first and second fasteners compress the sleeve against the outer surface of the downhole tool; and compression of the sleeve against the outer surface of the downhole tool by the first and second fasteners forms a fluid seal between the outer surface of the downhole tool and the sleeve.

7. The apparatus of claim 1 further comprising first and second gaskets positioned in corresponding first and second circumferential grooves extending into the downhole tool outer surface, wherein the first and second fasteners compress the sleeve against the respective first and second gaskets.

8. The apparatus of claim 7 wherein, when not compressed by the sleeve or the first and second fasteners, the first and second gaskets each have a non-circular cross-sectional shape.

9. The apparatus of claim 7 wherein the first and second gaskets each have an X-shaped cross-section.

10. The apparatus of claim 1 wherein the first and second fasteners are embedded within the sleeve.

11. The apparatus of claim 1 wherein the first end of the sleeve is wrapped around the first fastener, and wherein the second end of the sleeve is wrapped around the second fastener.

12. The apparatus of claim 1 wherein the sleeve is a first sleeve, and wherein the fluid seal assembly further comprises a second sleeve extending around the first sleeve and the first fastener and a third sleeve extending around the first sleeve and the second fastener.

13. The apparatus of claim 12 wherein the second and third sleeves are formed of a material selected from the group consisting of a heat-shrinkable material, an elastomer, and a rigid material.

14. An apparatus comprising:

a downhole tool comprising an acoustic sensor operable for emitting and receiving acoustic signals to perform downhole measurements;

a fluid seal assembly comprising:

a sleeve disposed circumferentially around the downhole tool, wherein the sleeve is sufficiently acoustically transparent to pass the emitted and received acoustic signals; and a first fastener and a second fastener each extending circumferentially around the sleeve proximate respective first and second ends of the sleeve; and first and second gaskets positioned in corresponding first and second circumferential grooves extending into a downhole tool outer surface, wherein the first and second fasteners compress the sleeve against the respective first and second gaskets.

15. An apparatus comprising:

a downhole tool comprising an acoustic sensor operable for emitting and receiving acoustic signals to perform downhole measurements; and a fluid seal assembly comprising:

a sleeve disposed circumferentially around the downhole tool, wherein the sleeve is sufficiently acoustically transparent to pass the emitted and received acoustic signals; and a first fastener and a second fastener each extending circumferentially around the sleeve proximate respective first and second ends of the sleeve;

wherein the sleeve is a first sleeve, and wherein the fluid seal assembly further comprises a second sleeve extending around the first sleeve and the first fastener and a third sleeve extending around the first sleeve and the second fastener.

* * * * *